US011817642B2

(12) United States Patent
Böcker et al.

(10) Patent No.: US 11,817,642 B2
(45) Date of Patent: Nov. 14, 2023

(54) MODULAR PLUG CONNECTOR FOR A PRINTED CIRCUIT BOARD

(71) Applicant: Weidmüller Interface GmbH & Co. KG, Detmold (DE)

(72) Inventors: Marc Böcker, Steinheim (DE); Ralf Schumacher, Lemgo (DE); Peter Stuckmann, Lage (DE); Till Schmitz, Detmold (DE); Jens Oesterhaus, Detmold (DE); Jörg Münstermann, Schlangen (DE); Holger Wehmeier, Lemgo (DE); Volker Schröder, Lemgo (DE)

(73) Assignee: Weidmüller Interface GmbH & Co. KG, Detmold (DE)

( * ) Notice: Subject to any disclaimer, the term of this patent is extended or adjusted under 35 U.S.C. 154(b) by 123 days.

(21) Appl. No.: 17/446,230

(22) Filed: Aug. 27, 2021

(65) Prior Publication Data

US 2022/0077607 A1 Mar. 10, 2022

(30) Foreign Application Priority Data

Sep. 4, 2020 (DE) ..... 102020123188.1

(51) Int. Cl.
*H01R 13/514* (2006.01)
*H01R 12/51* (2011.01)
*H01R 12/71* (2011.01)

(52) U.S. Cl.
CPC ..... *H01R 12/515* (2013.01); *H01R 12/716* (2013.01); *H01R 13/514* (2013.01)

(58) Field of Classification Search
CPC .. H01R 12/515; H01R 12/716; H01R 13/514; H01R 4/4836; H01R 9/2408; H01R 13/639; H01R 24/00
See application file for complete search history.

(56) References Cited

U.S. PATENT DOCUMENTS 4,425,018 A 1/1984 Stenz
2010/0173531 A1* 7/2010 Holste ..... H01R 4/4836 439/700

(Continued)

FOREIGN PATENT DOCUMENTS

DE 3014755 A1 10/1981
DE 102016103361 A1 8/2017

(Continued)

*Primary Examiner* — Abdullah A Riyami
*Assistant Examiner* — Nelson R. Burgos-Guntin
(74) *Attorney, Agent, or Firm* — LAUBSCHER & LAUBSCHER, P.C.

(57) ABSTRACT

A modular plug connector in a strip-shaped design can be plugged together with a corresponding mating plug connector such as a printed circuit board plug connector. The modular plug connector has a plurality of plug connector modules which are arranged alongside one another and are connected mechanically to one another using mechanical connectors to form the strip shape. The plug connector modules each have a module housing, at least one plugging surface with at least one plugging contact and preferably at least one conductor or solder terminal for connection to a printed circuit board. The plug connector has at least two plug connector modules of different designs and an adapter plug connector module is provided therebetween.

14 Claims, 6 Drawing Sheets

(56) References Cited

U.S. PATENT DOCUMENTS

| | | | | |
|---|---|---|---|---|
| 2017/0025805 | A1* | 1/2017 | Pizzi | H01R 9/2675 |
| 2017/0188479 | A1* | 6/2017 | Unger | H01R 9/26 |
| 2017/0229825 | A1* | 8/2017 | Baines | H01R 13/514 |
| 2017/0352980 | A1* | 12/2017 | Stuckmann | H01R 4/4836 |
| 2019/0260170 | A1* | 8/2019 | Schmitz | H01R 25/164 |
| 2019/0319374 | A1* | 10/2019 | Herrmann | H01R 4/4827 |
| 2020/0044381 | A1* | 2/2020 | Stremlau | H01R 13/518 |
| 2020/0176918 | A1* | 6/2020 | Wolf | H01R 13/518 |
| 2021/0234304 | A1* | 7/2021 | Zebhauser | H01R 13/6272 |
| 2022/0077607 | A1* | 3/2022 | Böcker | H01R 13/514 |
| 2022/0077624 | A1* | 3/2022 | Böcker | H01R 12/722 |
| 2022/0209463 | A1* | 6/2022 | Chen | H01R 13/635 |
| 2022/0320759 | A1* | 10/2022 | Böcker | H01R 4/4827 |
| 2023/0006392 | A1* | 1/2023 | Jost | H01R 43/0256 |

FOREIGN PATENT DOCUMENTS

| | | | |
|---|---|---|---|
| DE | 102017119287 | A1 | 2/2019 |
| FR | 2776844 | A3 | 10/1999 |
| WO | 2019141597 | A1 | 7/2019 |

* cited by examiner b)

c)

MODULAR PLUG CONNECTOR FOR A PRINTED CIRCUIT BOARD

This application claims priority of DE 10 2020 123 188.1 filed Sep. 4, 2020, the entire contents of which are incorporated herein by reference.

BACKGROUND OF THE INVENTION

The invention relates to a modular plug connector for contacting a mating plug connector, in particular a printed circuit board plug connector.

The object of the invention is to provide a modular plug connector for contacting such a mating plug connector, which has a particularly simple and versatile structure that can be adapted to various applications.

SUMMARY OF THE INVENTION

According to the invention, a modular plug connector in a strip-shaped design is provided which can be plugged together with a corresponding mating plug connector in particular with a printed circuit board plug connector. The modular plug connector has a plurality of plug connector modules which are arranged alongside one another and are connected mechanically to one another using mechanical connectors to form the strip shape. The plug connector modules each have a module housing, at least one plugging face with at least one plugging contact and preferably at least one conductor terminal and/or one solder terminal for connection to a printed circuit board. The plug connector has at least two plug connector modules of different designs or configurations, and an adapter plug connector module is arranged between the at least two plug connector modules of different designs. The adapter plug connector module makes it possible to produce a transition between the plug connector modules of different designs. Thus, several plug connector modules of the first design can be provided, to which the adapter plug connector module is connected, to which several plug connector modules of the second design are connected. More than two adapter plug connector modules can also be provided in order to be able to arrange plug connector modules of more than two designs alongside one another.

According to one embodiment, the plug connector modules of the modular plug connector are not held in a holding frame but rather are mechanically connected to one another at their sides. Accordingly, with the adapter plug connector module, a modular plug connector with terminal modules of different designs can be provided without a holding frame.

The plug connector modules each have a front side and a rear side each having mechanical connectors which correspond to plug connector modules which are arranged directly alongside one another. In this case, the module housing of the adapter plug connector module has on its front side mechanical connectors which correspond to mechanical connectors of the module housings of the plug connector modules of the first design and that it has on its rear side, mechanical connectors which correspond to mechanical connectors of the module housings of the plug connector modules of the second design. The mechanical connectors of the plug connector modules of the first design are not compatible with the mechanical connectors of the plug connector modules of the second design. In this way the adapter plug connector enables the mechanical connection of adjacent plug connectors of different designs in a simple manner.

These adapter plug connector modules are preferably inherently formed as complete plug connector modules of a first overall size but with module housings with the front side and the rear side configured in such a way that they allow a further plug connector module of the first overall size at one side and a plug connector module of a second different design, in particular overall size, at the other side.

In this case according to one embodiment, it is simple and expedient if the corresponding mechanical connectors have one or more locking hooks and one or more corresponding locking receptacles which form locking devices which are locked to one another on plug connector modules which are arranged alongside one another.

According to a an alternate embodiment, the corresponding mechanical connectors have one or more pegs and one or more corresponding receiving openings. Therefore, the peg or pegs have a non-circular, in particular polygonal, cross-section and the receiving hole or holes have a corresponding polygonal cross-section to provide security against relative twisting of module housings which are arranged alongside one another.

According to a preferred embodiment, the locking hooks and/or the pegs on the rear side of the respective adapter plug connector module have a different spacing from one another than the locking receptacles and/or the receiving openings on the front side of the respective adapter plug connector module. In this way, the mechanical connectors can be tailored in a simple manner to the respective housing sizes of the terminal strip. Furthermore, the module housings of different designs differ from one another at least in that they have a different overall size, and the adapter plug connector modules each have a front side that has a different size than its rear side. According to a further embodiment, at least one of the module housings has a receptacle for a complete plug connector that is provided with a dedicated housing, conductor terminal and plugging surface with a plugging contact. This plug connector can be configured in a different way, for example as a data plug connector with more than one contact member and shielding devices, as an optical connector or as a differently configured transmission member.

In addition, at least one of the module housings can have a double or multiple plugging surfaces.

Overall, the plugging surfaces of the modular housings can be fully or partially configured identically or differently.

BRIEF DESCRIPTION OF THE FIGURES

The invention will be described hereinafter with reference to the accompanying drawings in which.

DETAILED DESCRIPTION

Figure 1:
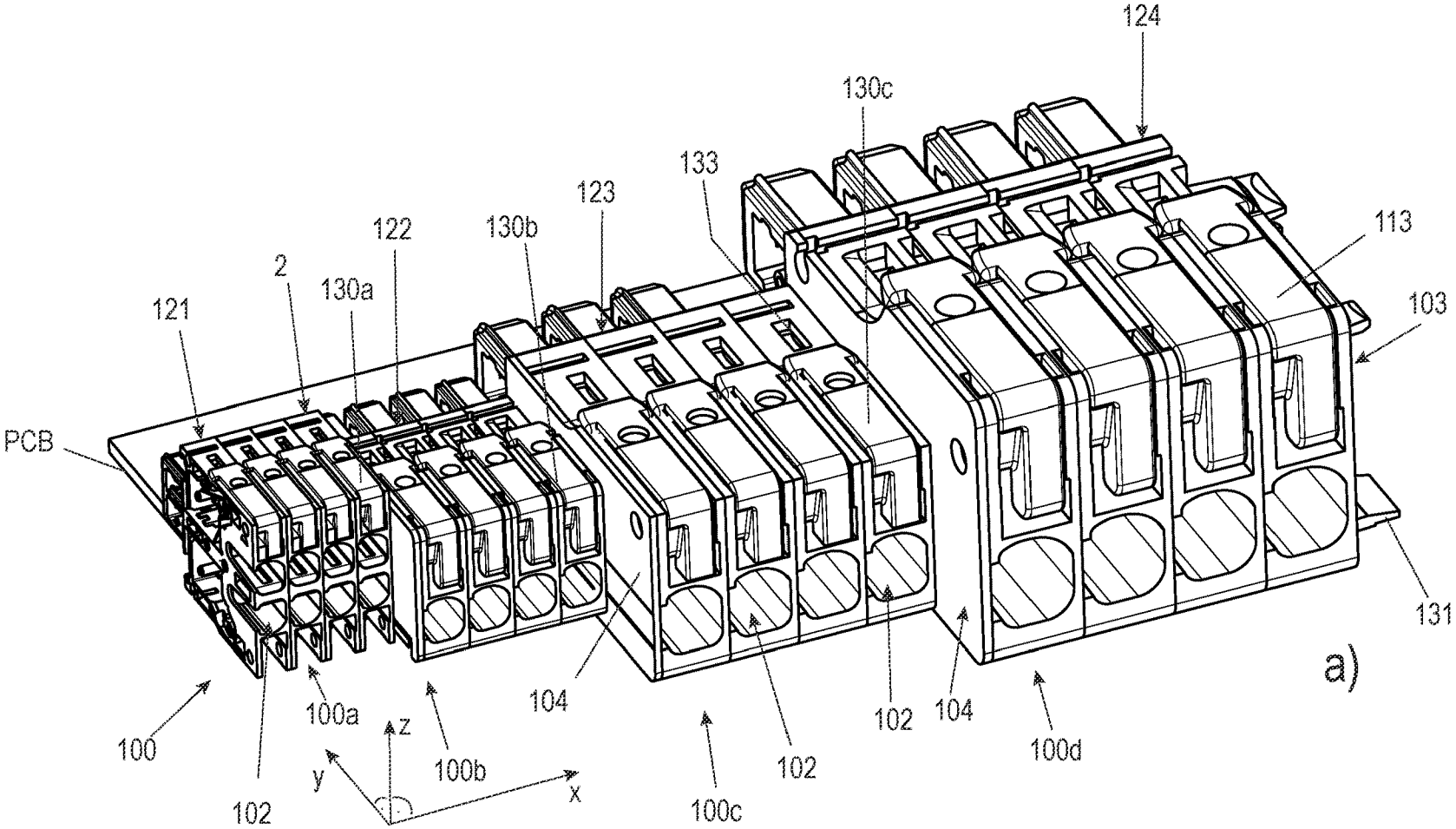
FIG. 1*a* is a perspective view of a strip-like modular plug connector which can be plugged together with a mating plug connector such as a modular printed circuit board plug connector.
FIG. 1*b* is a perspective view of a section of a further strip-like modular plug connector without a mating plug connector.
FIG. 1*c* is a perspective view of an adapter plug connector module of the modular plug connector FIG. 1*b* with a plug connector module arranged alongside.
Figure 1:
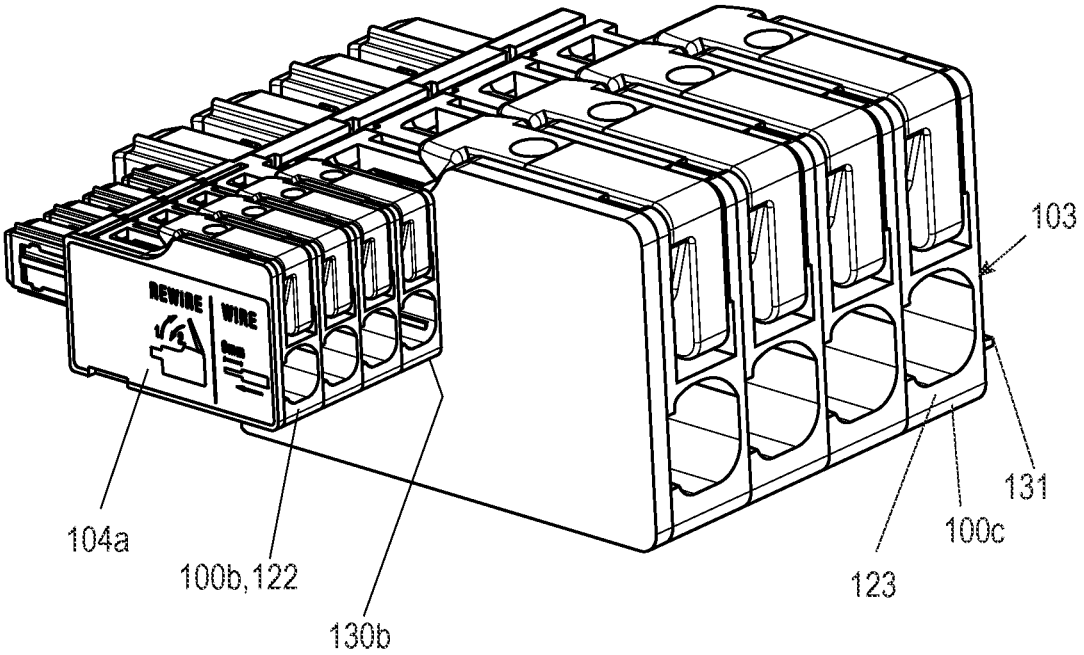
Figure 1:
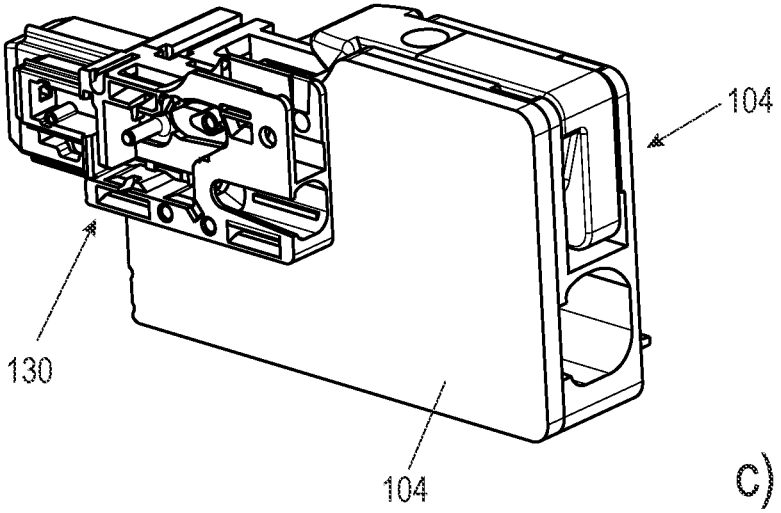
Figure 2:
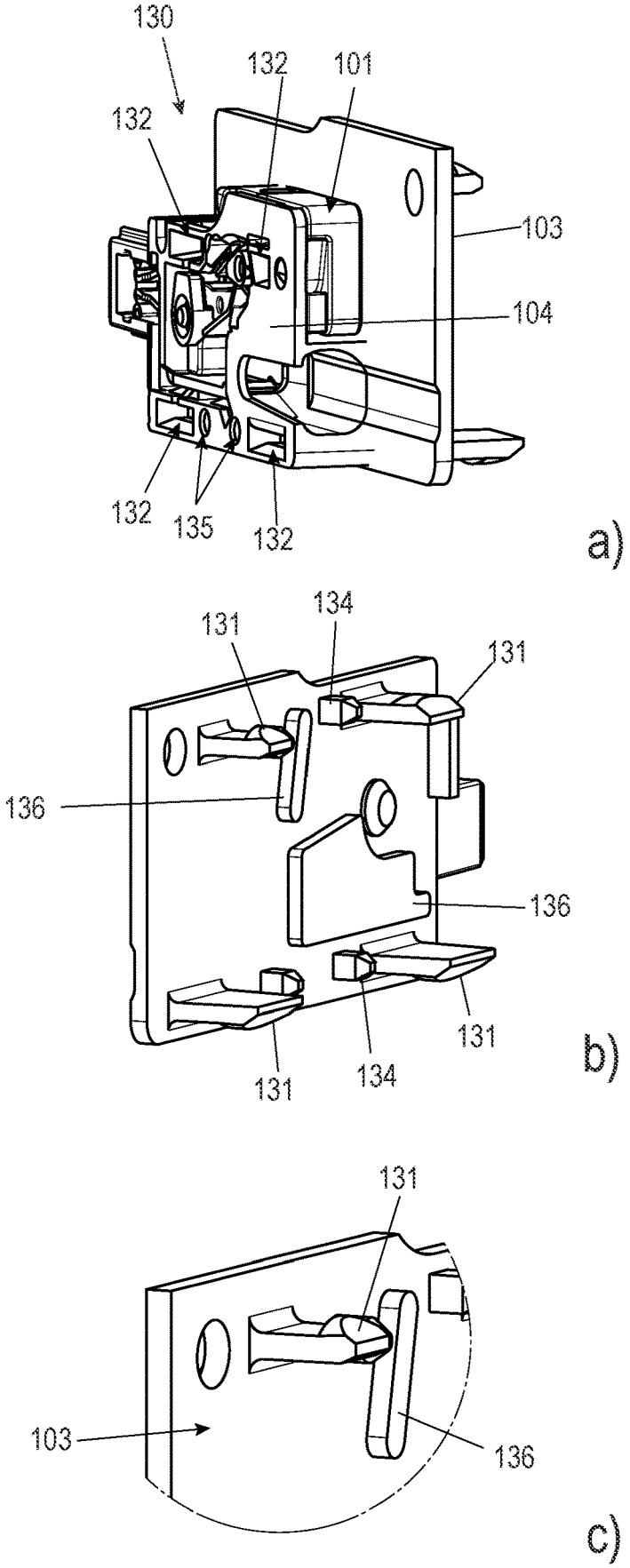
FIGS. 2*a* and 2*b* are front and rear perspective views, respectively of an adapter plug module for a modular plug connector of FIG. 1.
FIG. 2*c* is an enlarged partial sectional view of a portion of FIG. 2*b;*
Figure 4:
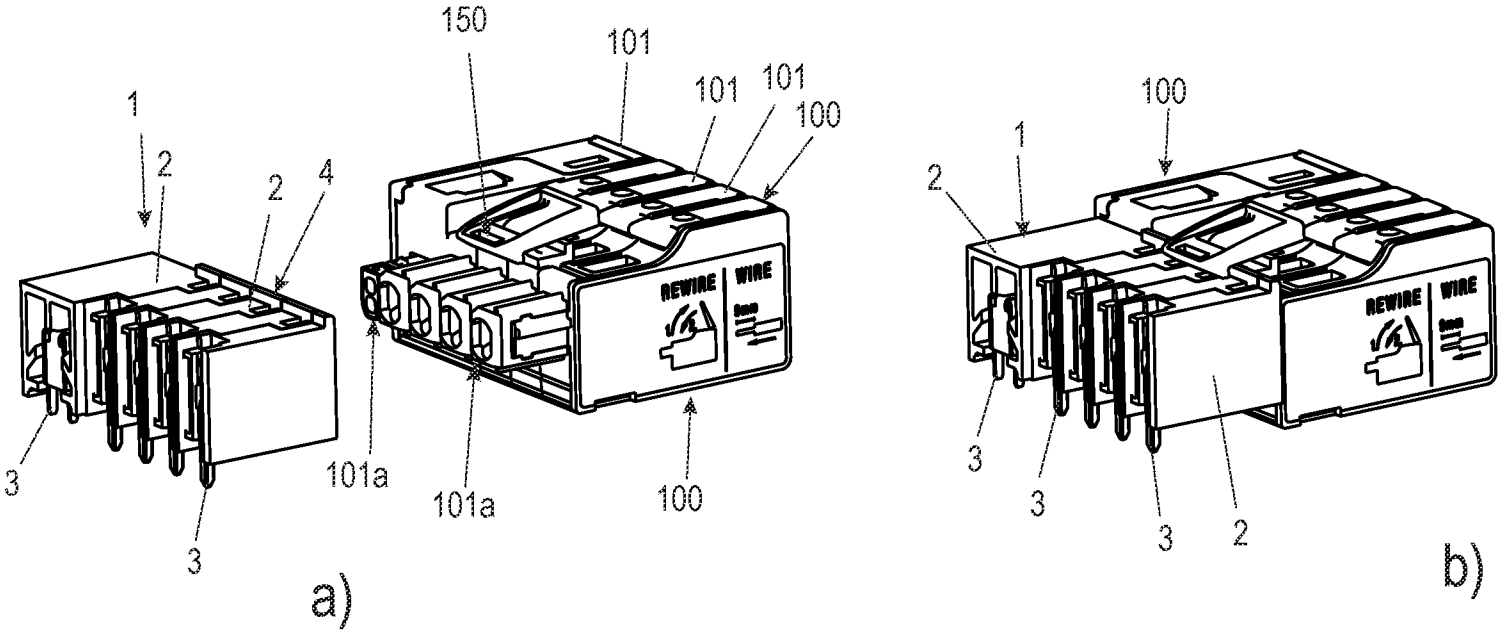
FIGS. 4*a* and 4*b* are perspective views of a terminal strip formed as a printed circuit board plug connector in disassembled and assembled conditions, respectively.
Figure 5:
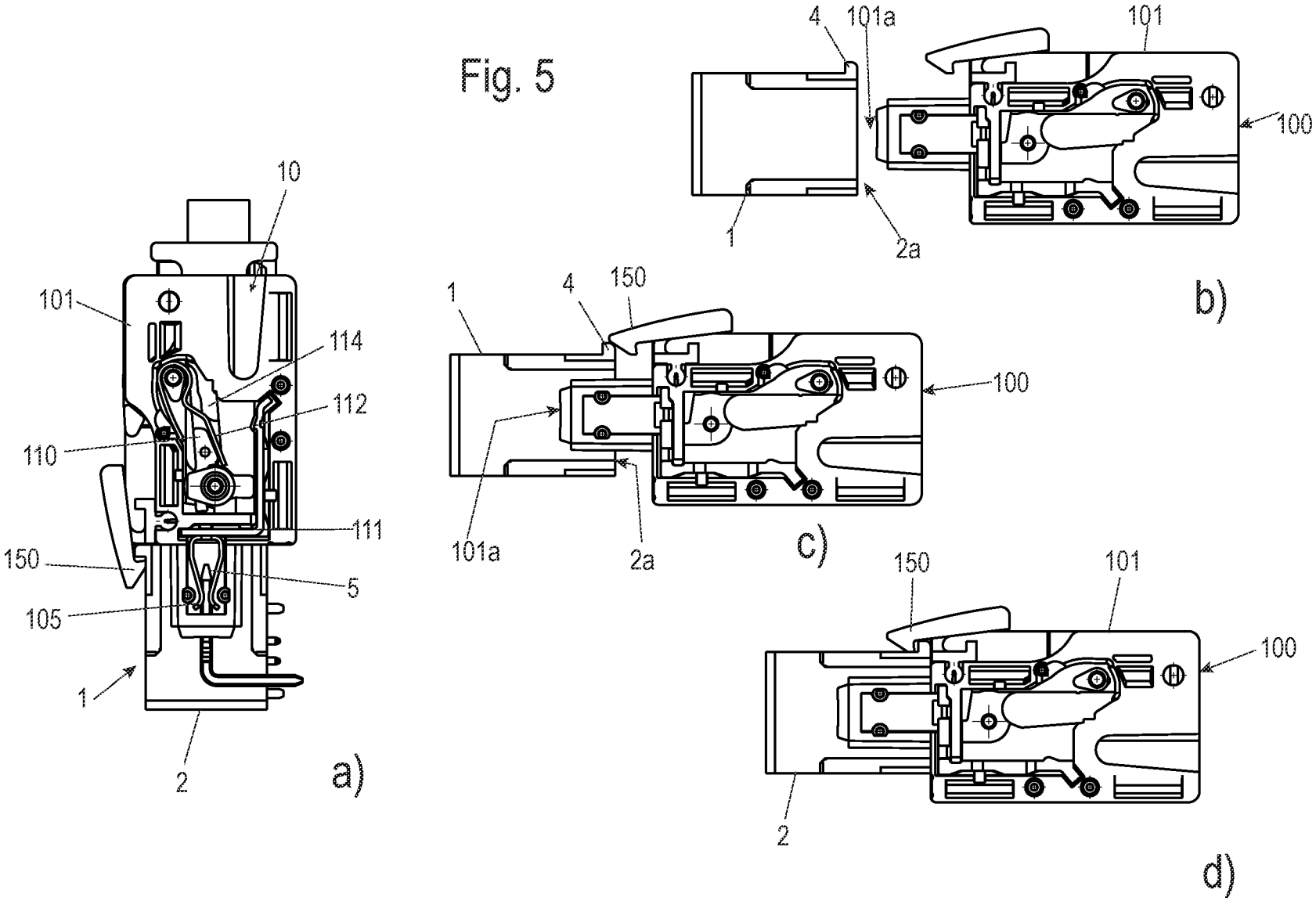
FIG. 5*a* is a lateral sectional view of a plug connector assembly with a printed circuit board plug connector and a modular plug connector in an assembled plugged-together condition.
FIGS. 5*b*, 5*c*, and 5*d* are side sectional views of the plug connector assembly without metal and contact actuating members of the corresponding plug connectors in an unplugged, partially plugged, and fully plugged state, respectively.

FIG. 1*a* shows a strip-like modular plug connector 100 which can be plugged together with a mating plug connector that can be configured as a modular printed circuit board plug connector 1 as shown in FIGS. 4 and 5*a* but that could also be configured as a plug connector for connection with a cable. In this case, the mating plug connector 1 can be arranged on a printed circuit board (PCB) and can be connected thereto on one of its sides at least in an electrically conductive and where desired in a mechanical manner such as via one or more solder connections on soldering pins 3.

The modular plug connector 100 is formed like a strip. It has a plurality of plug connector modules 100*a*, 100*b*, 100*c*, . . . which are arranged alongside one another and are mechanically connected to one another to form the strip.

Figure 3:
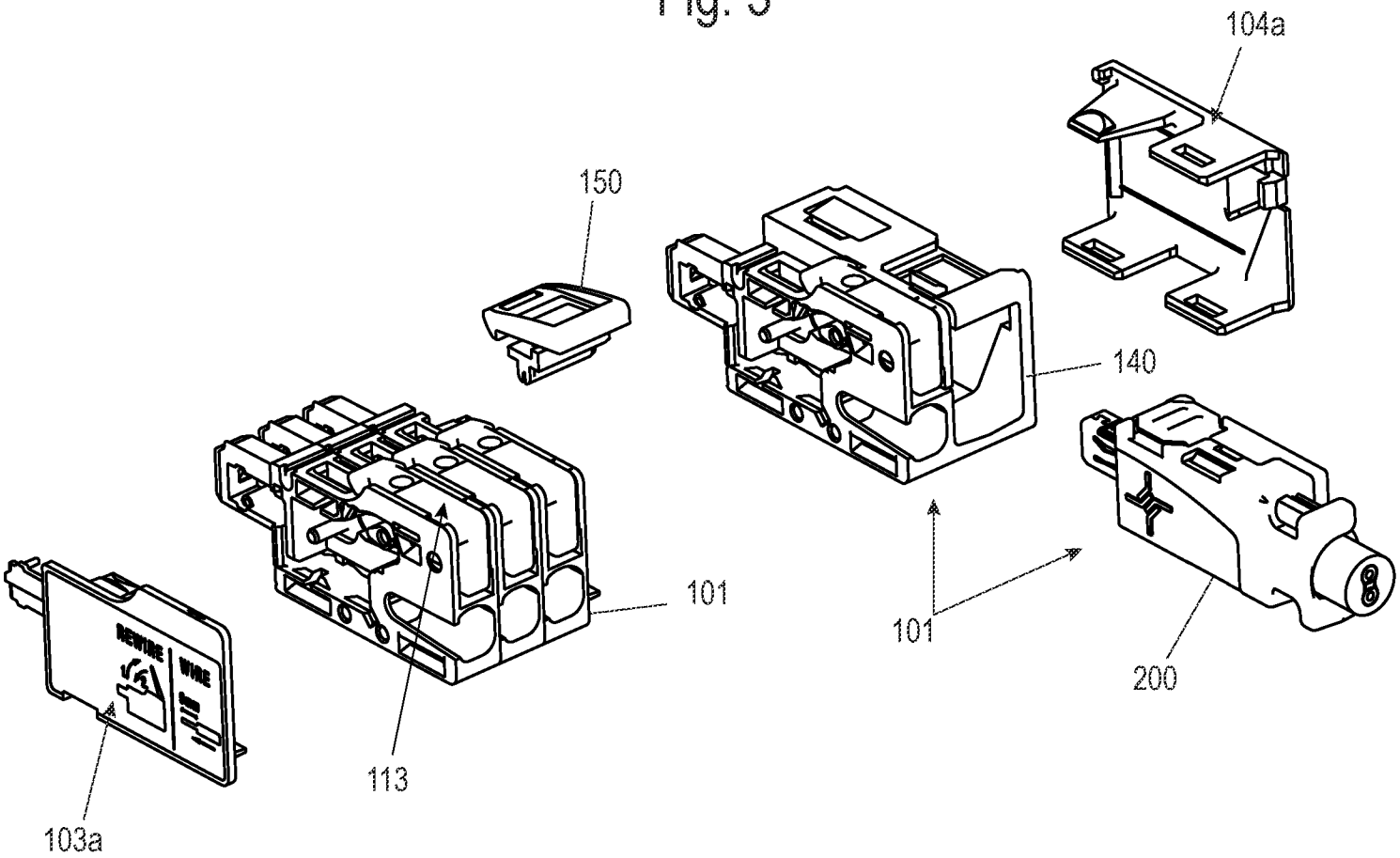
FIG. 3 is an exploded perspective view of a modular plug connector.

The plug connector modules, also referred to as modules 100*a*, . . . , are arranged alongside one another in a straight arranging direction x. The modules 100*a*, . . . each have a module housing 101. The respective module housing 101 has a plugging surface 101*a* for plugging together with a corresponding plugging surface 2*a* of a section of the mating plug connector 1, which likewise can be modular in structure. For plugging-together, the plug connector 100 is moved in a plugging direction y perpendicular to the direction x and is plugged together with the mating plug connector 1 such as a printed circuit board plug connector. Plugging contacts 105 (FIG. 5*a*) of the modular plug connector 100 contact mating plugging contacts 5 of the mating plug printed circuit board plug connector 1. The direction perpendicular to the printed circuit board PCB is denoted by z. The first (i.e. left in FIG. 3) plug connector module and/or the last plug connector module have a cover plate 104*a* and/or an end plate 103*a* in and counter to the arranging direction x as shown in FIG. 3.

The plugging contacts 105 are formed on a respective plugging surface on a plugging side 101*a* of the plug connector modules of the plug connector 100. The corresponding plugging contacts 5 of the mating plug connector 1 are formed on a corresponding plugging surface. One or more plugging surfaces can be formed on one or more of the plug connector modules of the plug connector 100. Therefore, one or more of the plug connector modules can have two plugging surfaces, one above another in the nature of a collar and at least one plugging contact.

The mating plug connector 1 can also be formed as a plug connector for use without a printed circuit board, for example for the connection of conductor ends, and can form part of a flying plug connector coupling (not shown).

The terminal housing 2 of the printed circuit board plug connector 1 has one or more of the mating plugging contacts 5 on the plugging surface side 2*a* as shown in FIG. 5*a*. These are formed as one or more pin contacts 5. Instead of pin contacts, blade contacts or tulip contacts can also be provided as the mating plugging contacts on the plugging surface side 2*a*. Mixed forms with pin and tulip contacts and/or shielding contacts are also possible.

In contrast, the plugging contacts 105 of the modules 101 of the plug connector 100 on its plugging surface side are preferably formed as socket contacts. However, they can also be formed as pin or blade contacts to correspond to the mating plugging contacts 5. Mixed forms of contacts are also possible. The plugging contacts 5 can be connected to pin contacts 3 for soldering onto the printed circuit board PCB or they can be connected integrally as shown for example in FIG. 3).

In the respective plug connector module, the plugging contacts 105 of the modules are electrically conductively connected to a respective conductor terminal 110 for the connection of at least one stripped conductor end such as via a bus bar 111 (FIG. 5*a*). The conductor terminal 110 can be formed as a direct plug terminal using push-in technology which has a compression spring 112 and an actuating assembly for opening a clamping point which has a lever 113 and a pusher 114 with which pressure can be exerted onto the compression spring 112 in order to open a clamping point between the bus bar 111 and the compression spring 112 for contacting the conductor (not). The conductor terminal could, however, also be formed with another connection technology, such as, for example, a tension spring terminal, IDC terminal or a screw terminal.

The module housings 101 have an insertion aperture 102 for inserting the conductor end into the clamping point in the module housing 101 on the side facing away from the plugging surface.

The module housings 101 are arranged alongside one another in an arranging direction x. In this direction, they each have a first side, which is also referred to hereinafter as the front side 104 as shown in FIG. 1*a*. Furthermore, they have a second side, which is also referred to hereinafter as the rear side 103. The rear side 103 can be formed as a substantially closed wall.

The front side 104 also forms a type of wall, but it can be configured in sections to be more open than the more closed rear side 103 since metal parts can be mounted from the front side 104. These can additionally be configured to be wider in the arranging direction, if the front side 104 is not also formed to be as closed as the rear side 103 which can then support the metal parts in this direction.

The plug connector 100 can have exclusively module housings 101 of identical design. However, it is preferred to include module housings 101 of different designs.

In addition, transition plug connector modules or adapter plug connector modules 130*a*, 130*b*, 130*c* are provided for the transition between the various plug connector modules and their module housings 101 of different designs.

In FIG. 1*a* by way of example, the plug connector 100 has at one of its ends several plug connector modules 100*a* which have module housings 121 of a first design, then a first adapter plug connector module 130*a*, several plug connector modules 100*b* arranged alongside which have module housings 122 of a second design, then a second adapter plug connector module 130*b*, several plug connector modules 100*c* connected thereto which have terminal housings 123 of a third design, then a third adapter plug connector module 130*c*, and several plug connector modules 100*d* connected thereto which have terminal housings 124 of a fourth design.

In FIG. 1*b* by way of example, a plug connector has several plug connector modules 100*b* with terminal housings 122 of a first design, then a first adapter plug connector module 130*b*, and several plug connector modules 100*c* connected thereto which have terminal housings 123 of a second design.

FIG. 1*c* is a perspective view of an adapter plug connector module 130. This adapter plug connector module 130 enables a mechanical connection and coupling of adjacent plug connector modules 100*a*, 100*b*, 100*c*, . . . of different designs, in particular different overall sizes. The adapter plug connector modules 130 in turn can be provided in correspondingly different overall sizes. The adapter plug connector module itself also has the same structural elements of the plug connector modules of the first design.

In order to arrange the module housings 101 of the plug connector modules 100*a*, . . . alongside one another (also the adapter plug connector module or modules 130*a*, . . . ), so that they solidly and securely form a strip-like modular plug connector 100, they have on the two sides—that is to say on the front side 104 and on the rear side 103—corresponding mechanical connectors.

The members 131 and 136 can be provided or formed on the adapter plug connector modules 130*a*, . . . and also on the further plug connector modules 100*a*, . . . which are not formed as adapter plug connector modules.

Here, the mechanical connectors include several locking hooks 131 which are arranged on the rear side 103 and protrude from it in the direction x. The locking hooks 131 are configured for the purpose of locking into locking receptacles or recesses 132 during the plugging-together of adjacent module housings, the receptacles or recesses being formed in the front side 104 of the adjacent module housings 101 which are arranged alongside one another.

Preferably, the locking hooks 131 are releasable from the locked state, for example via access apertures such as the access aperture 133 in FIG. 1*a*, for example in the walls of the module housings 101*a*, . . . , 130*a*, . . . which are perpendicular to the rear side 103. However, the locking hooks can also be fixed so as not to be releasable.

In addition, one or more pins 134 which protrude from the rear side 103 are provided for the purpose of engaging in a form-fitting manner and preferably also in a force-fitting manner in corresponding receiving holes 135 in the front side 104.

If several of the pins 134 and receiving holes 135 are provided, they can have an identical or different cross-section.

Overall, secure seating of adjacent module housings 101 in the modular plug connector 100 can be ensured in particular by a combination of a locking connection with locking hooks 131 and locking receptacles 132 and also a press-fit connection with press pins 134 and receiving openings 135.

One or more support ribs 136 or other functional contours can be provided on the rear side 104 in order to prevent incorrect plugging of conductors or to support functional elements of the conductor terminal.

Preferably, one or more of the pins 134 and one or more of the receiving holes 135 are formed in such a way that they have a corresponding non-circular cross-section, for example a corresponding polygonal cross-section, so that in the plugged-together state, they also secure adjacent module housings 101 against relative twisting about an axis parallel to the direction x.

The module housings 121, 122, 123, 124 of different designs may differ from one another in that they have a different overall size. As such they have different sizes of front sides 104 or rear sides 103.

The different overall sizes can be a result of the plug connector modules being configured for connection of conductors having different cross-sections, for example once for the connection of conductors with a cross-section of 2 to 4 mm and once for the connection of conductors with a cross-section of 3 to 6 mm. Then the individual members of the plug connector modules are only dimensioned to have different sizes such as differently sized clamping springs and differently dimensioned module housings 101, 121, 122, 123, 124, etc.

During use of differently sized module housings 101, 121, 122, 123, 124, it is preferred that the spacing of the mechanical fastening devices, i.e. the spacing of the locking hooks or locking receptacles 131, 132 relative to one another and/or the spacing of the pins 134 and receiving openings 135, is also different in relation to one another when the overall sizes are different. In addition, the locking hooks 131 and locking receptacles 132 and/or pins 134 and receiving openings 135 are of different sizes.

As such, module housings 121, 122, 123, 124 of different overall sizes could not then be mechanically coupled directly in the arranging direction.

This problem is solved in a simple manner by the fact that the adapter plug connector modules 130 are provided for the mechanical connection or coupling of adjacent module housings 101 or plug connector modules of different designs, in particular of different designs.

These adapter plug connector modules 130 are inherently formed as complete plug connector modules of a first design, preferably of a first smaller overall size, but have module housings with a front side 103 and a rear side 104, which are configured in such a way that they allow the arrangement of a further plug connector module of the first overall size towards a first side and the arrangement of a plug connector module of a second different design, in particular other overall size, towards the other side.

Furthermore, corresponding to the various designs or sizes on the front side 103 and the rear side 104, the mechanical connectors are arranged differently, and in particular are spaced apart to different extents relative to one another in a manner corresponding to the various overall sizes. In this case, the mechanical connectors can also be arranged at different heights in the z direction on the front side and the rear side as shown in FIGS. 1*a* and 1*b* for example.

The strip-shaped and module-like plug connector 100 in FIG. 1*a* has plug connector modules 122, 123, 124 of different overall sizes which otherwise have an identical design. They each have a single terminal such as a push-in terminal for the connection of a conductor end and a plugging or socket contact 105.

In contrast, first plug connector modules 100*a* viewed from the left in FIG. 1*a* have not only a different overall size than the further plug connector modules. These first terminal housings 121 each have two push-in terminals and correspondingly also more plugging contacts. In addition, they are distributed on two plugging surfaces 101*a* which are arranged above one another in the z direction.

One of the plug connector modules 101 may have at least one plugging contact and a shielding contact 105*a* that is formed as a further plugging contact as shown in FIG. 3.

According to a further configuration, one of the module housings 101 of one of the plug connector modules 100*a*, 100*b*, 100*c*, . . . forms a type of receptacle 140 for an inherently complete plug connector module 200 which in itself has a dedicated housing, conductor terminal and plugging surface with plugging contact. This is depicted in FIG.

3 for example. The plugging face of the module housing 101 with the at least one plugging contact and the conductor terminal remain accessible.

In this way, a separate different plug connector 200, which does not have mechanical connectors and would not be arrangeable per se, can be integrated into the parent plug connector 100. For this purpose, the receptacle 140 has mechanical connectors which are compatible with the connectors of a module housing 101 of at least one further plug connector module of the plug connector as shown in FIG. 3.

The plugging surfaces of the module housings 101 can thus be configured to be entirely or partially identical or wholly or partially different. In this regard, even a hybrid plug connector with module housings 101 can be formed using partially different connection technology.

The mechanical connection between the plug connector 100 and the mating plug connector 1 can be optimized by providing a locking hook connection between the plug connector 100 and the mating plug connector 1.

For this purpose, a lockable locking hook 150 can be provided, which is configured for insertion into a receiving contour of one or more module housings 101, the locking hooks 150 being lockable on a locking edge 4, for example a locking flange of the mating plug connector 1 as shown in FIGS. 3, 4*a* and 4*b*.

The invention claimed is:

1. A modular plug connector, comprising (a) a plurality of plug connector modules arranged alongside one another and mechanically connected with one another directly to form a strip configuration, each plug connector module having a housing, at least one plugging surface having at least one plugging contact at least two of said plug connector modules having different mechanical connection configurations; and (b) an adapter plug connector module arranged between and mechanically connected with said at least two plug connector modules of different configurations.

2. The modular plug connector as defined in claim 1, wherein said plug connector modules each have a front side and a rear side each having mechanical connectors which correspond with adjacent plug connector modules.

3. The modular plug connector as defined in claim 2, wherein said plug connector modules are free-standing.

4. A modular plug connector, comprising (a) a plurality of plug connector modules aranged alongside one another and mechanically connected with one another directly to form a strip configuration via mechanical connectors, each plug connector module having a housing, at least one plugging surface having at least one plugging contact, at least two of said plug connector modules having different mechanical connection configurations; and (b) an adapter plug connector module arranged between and mechanically connected with said at least two plug connector modules of different configurations, wherein said adapter plug connector module is configured as a complete plug connector module and includes a housing having a front side including a mechanical connector which corresponds with said mechanical connectors of said module housings of said plug connector modules of a first configuration and having a rear side including a mechanical connector which corresponds with said mechanical connectors of said module housings of said plug connector modules of a second configuration, wherein said mechanical connectors of said plug connector modules of said first configuration are incompatible with said mechanical connectors of said plug connector modules of said second configuration.

5. The modular plug connector as defined in claim 4, wherein said corresponding mechanical connectors include at least one locking hook and at least one corresponding locking receptacle.

6. The modular plug connector as defined in claim 4, wherein said corresponding mechanical connectors include at least one peg and at least one corresponding receiving opening.

7. The modular plug connector as defined in claim 6, wherein said at least one peg has a polygonal cross-section and said at least one receiving opening has a corresponding polygonal cross-section.

8. The modular plug connector as defined in claim 5, wherein said locking hooks on said rear side of said adapter plug connector module have a different spacing from one another than said locking receptacles on said front side of said adapter plug connector module.

9. The modular plug connector as defined in claim 1, wherein said housings of said plug connector modules of different configurations differ from one another in size and wherein said adapter plug connector module has a front side of a different size than a rear side.

10. The modular plug connector as defined in claim 1, wherein at least one of said module housings contains a receptacle for a complete plug connector provided with a dedicated housing, conductor terminal and plugging surface having a plugging contact.

11. The modular plug connector as defined in claim 1, wherein at least one of said module housings includes a multiple plug surface.

12. The modular plug connector as defined in claim 11, said plug surface of said module housings are at least partially configured differently.

13. The modular plug connector as defined in claim 1, and further comprising a locking hook connection between said plug connector and said mating plug connector.

14. The modular plug connector as defined in claim 13, wherein said locking hook connection includes a locking hook that can be fitted onto said plug connector, said locking hook being configured for placement into a receiving contour of at least one module housing, whereby said locking hook can be locked on a locking edge of said mating plug connector.

* * * * *